US006527607B1

(12) United States Patent
Huang

(10) Patent No.: US 6,527,607 B1
(45) Date of Patent: Mar. 4, 2003

(54) LUMINESCENT KITE APPARATUS

(75) Inventor: Kuo-Jung Huang, Taichung Hsien (TW)

(73) Assignees: Jan-Fu Chen, Taichung Hsien (TW); Jason El Technology Co., Ltd., Taichung (TW)

( * ) Notice: Subject to any disclaimer, the term of this patent is extended or adjusted under 35 U.S.C. 154(b) by 0 days.

(21) Appl. No.: 10/109,289

(22) Filed: Mar. 28, 2002

(30) Foreign Application Priority Data

Oct. 16, 2001 (TW) ..... 90217645 U

(51) Int. Cl.[7] ..... A63H 27/08

(52) U.S. Cl. ..... 446/34; 446/175; 362/253; 244/155 R

(58) Field of Search ..... 446/175, 34, 176, 446/219; 362/249, 253, 800, 806; 244/155 R

(56) References Cited

U.S. PATENT DOCUMENTS 4,942,506 A * 7/1990 Flory ..... 244/155 R
5,528,476 A * 6/1996 Fenton ..... 244/155 R
6,283,414 B1 * 9/2001 Quinones et al. ..... 244/153 R

* cited by examiner

*Primary Examiner*—Jacob K. Ackun
(74) *Attorney, Agent, or Firm*—Alan D. Kamrath; Rider, Bennett, Egan & Arundel

(57) ABSTRACT

A light-emitting kite apparatus includes a kite and a light-emitting device attached to the kite. The light-emitting device includes a light source and a circuit for driving the light source. The light source is a luminescent panel. The light source is mounted on a first side of the kite and the circuit is mounted on a second side of the kite. Two wires are used to connect the light source with the circuit. The wires are extended through a hole defined in the kite. The light source is mounted on the first side of the kite via a hook-and-loop device. The circuit is implemented as a circuit board. A micro-controller is installed on the circuit board in order to drive the light source to emit light in various ways. A switch is installed on the circuit board so that the switch can be operated in order to select from the ways in which the luminescent panel emits light. A vibration detector is installed on the circuit board under control of the micro-controller for detecting and notifying the micro-controller of vibration so that the micro-controller can cause the luminescent panel to twinkle. A box is used to contain the circuit. The box is mounted on the second side of the kite via a hook-and-loop device.

7 Claims, 6 Drawing Sheets

LUMINESCENT KITE APPARATUS

BACKGROUND OF INVENTION

1. Field of Invention

The present invention is related to a luminescent kite apparatus.

2. Related Prior Art

Kites are popular toys so that you can always see a lot of people playing with kites on sunny days. As a toy, a kite must be attractive. Conventionally, design of a kite is focused on its shape and a pattern that it carries. However, these factors somehow fail to exhibit enough attraction. In addition, a person cannot easily locate his or her kite in the sky at night as shown in FIG. 6.

SUMMARY OF INVENTION

It is an objective of the present invention to provide an attractive kite.

It is another objective of the present invention to provide a kite that can be easily observed by human eyes in the dark.

The above-mentioned and other objectives of the present invention are achieved by provision of a luminescent kite apparatus. The light-emitting kite apparatus includes a kite and a light-emitting device attached to the kite. The light-emitting device includes a light source and a circuit for driving the light source. The light source is a luminescent panel. The light source is mounted on a first side of the kite and the circuit is mounted on a second side of the kite. Two wires are used to connect the light source with the circuit. The wires are extended through a hole defined in the kite. The light source is mounted on the first side of the kite via a hook-and-loop device. The circuit is implemented as a circuit board. A micro-controller is installed on the circuit board in order to drive the light source to emit light in various ways. A switch is installed on the circuit board so that the switch can be operated in order to select from the ways in which the luminescent panel emits light. A vibration detector is installed on the circuit board under control of the micro-controller for detecting and notifying the micro-controller of vibration so that the micro-controller can cause the luminescent panel to twinkle. A box is used to contain the circuit. The box is mounted on the second side of the kite via a hook-and-loop device.

BRIEF DESCRIPTION OF DRAWING

The present invention is described through detailed illustration of embodiments referring to the attached drawings wherein.

DETAILED DESCRIPTION OF PREFERRED EMBODIMENTS

Figure 1:
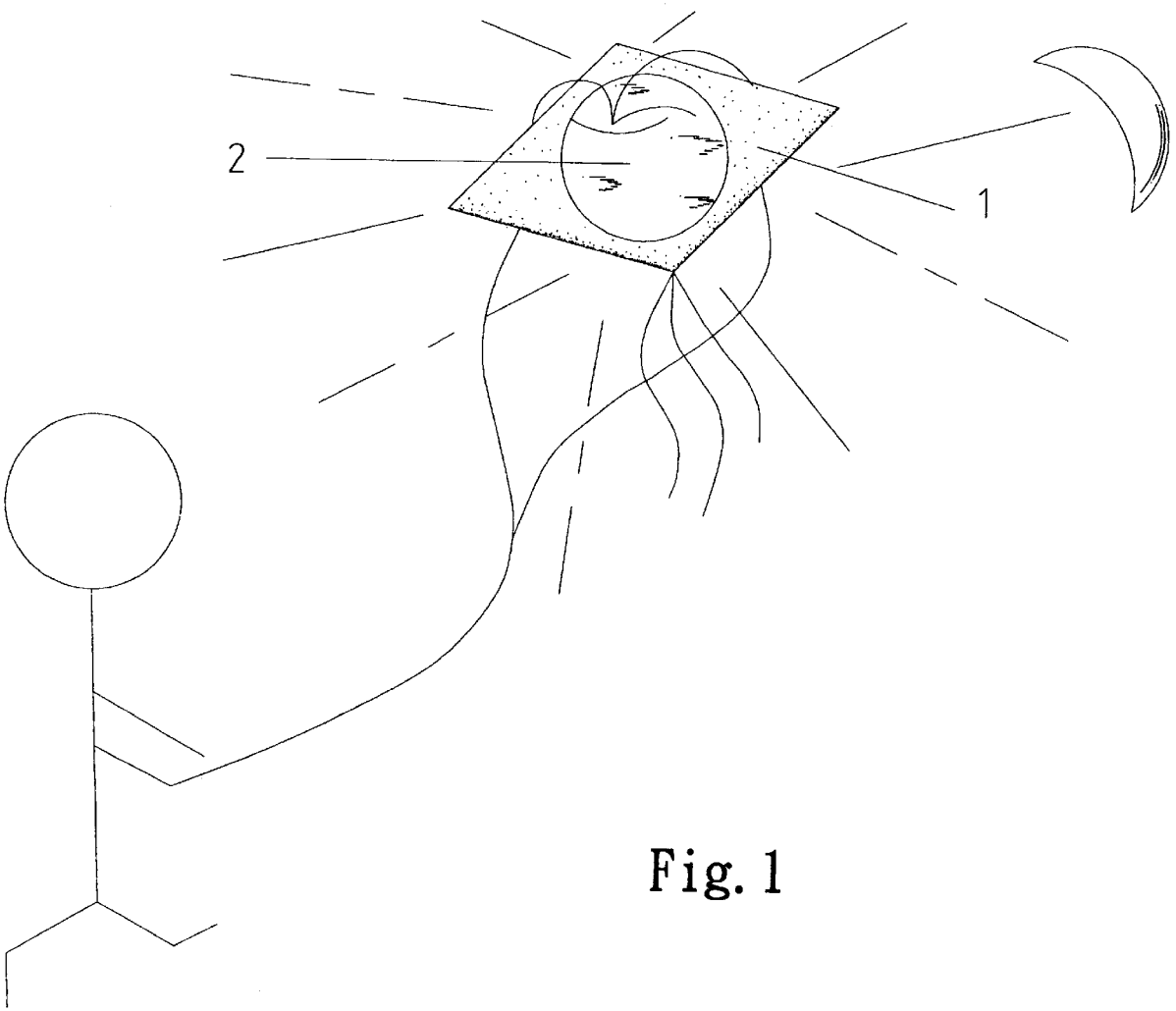
FIG. 1 is a view of a child playing with a kite apparatus according to the present invention.

FIG. 1 shows a person playing with a luminescent kite apparatus according to the present invention. The luminescent kite apparatus of the present invention can be easily observed by means of human eyes in the dark.

Figure 2:
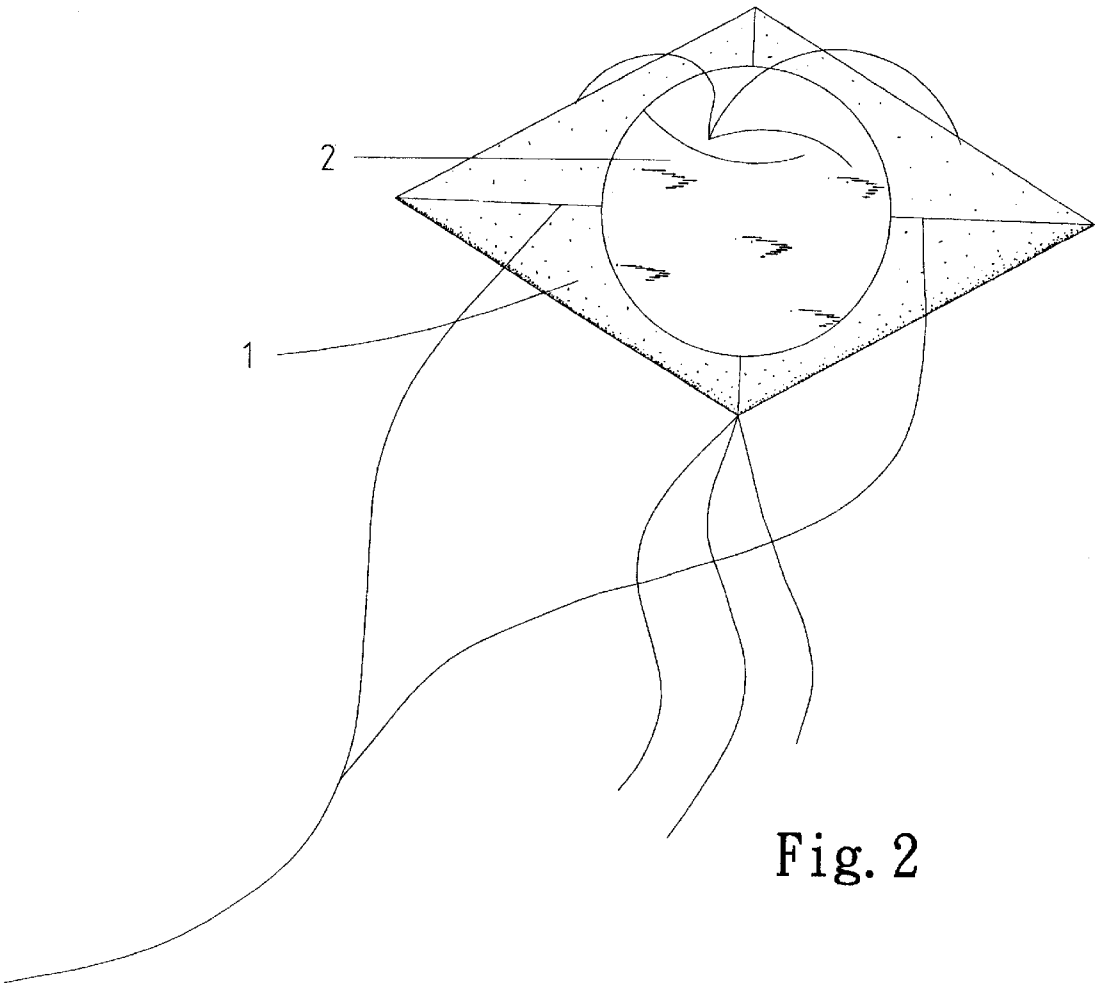
FIG. 2 is a front view of the luminescent kite apparatus of FIG. 1.
Figure 3:
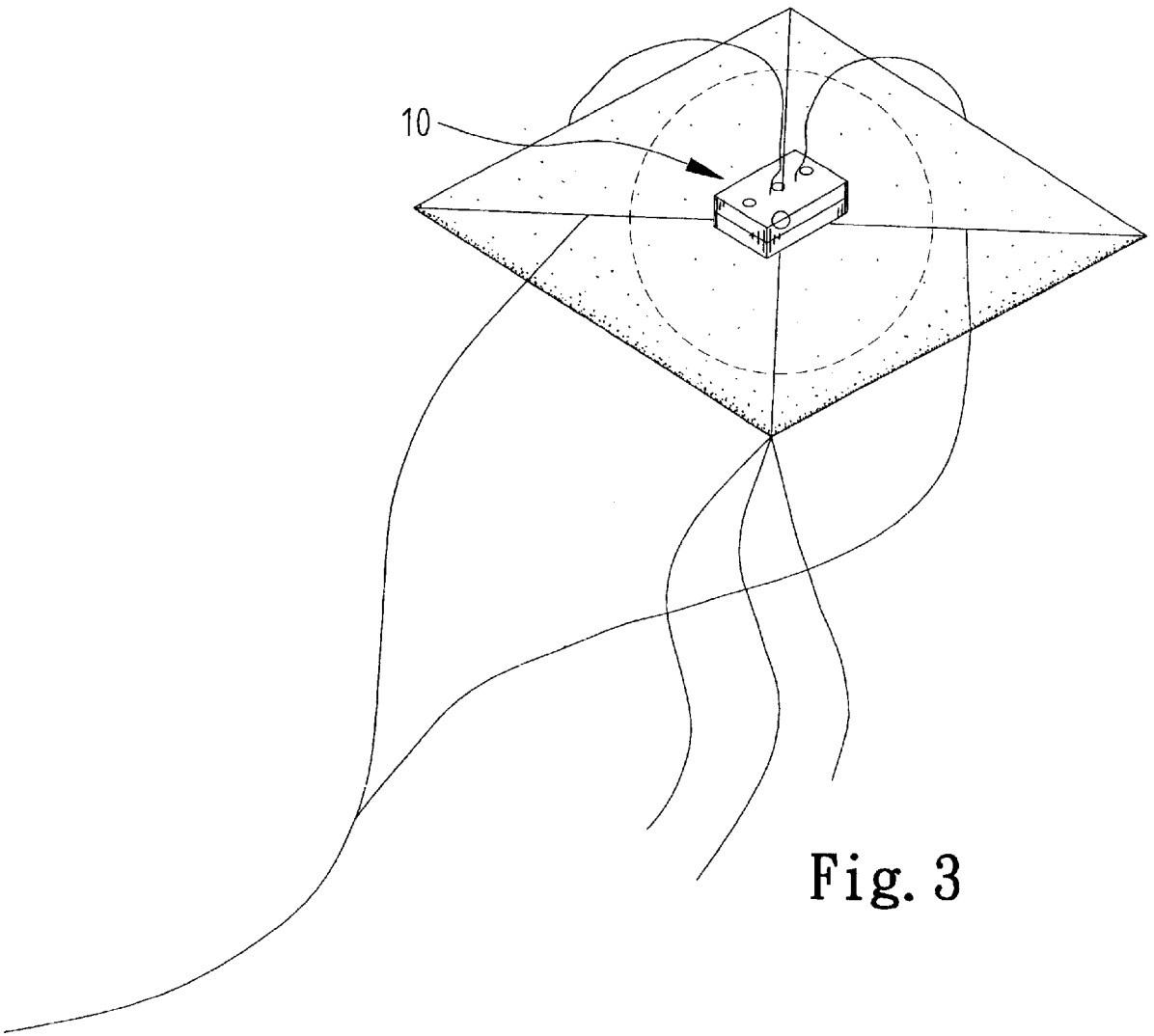
FIG. 3 is a rear view of the luminescent kite apparatus of FIG. 1.

Referring to FIGS. 2 and 3, according to the present invention, the luminescent kite apparatus includes a kite 1, a luminescent panel 2 and a box 10 containing a circuit for powering the luminescent panel 2. The kite 1 is conventional and therefore will not be described in detail. The luminescent panel 2 is mounted on a first side of the kite 1 as seen in FIG. 2 and the box 10 is mounted on a second side of the kite 1 as shown in FIG. 3.

Figure 4:
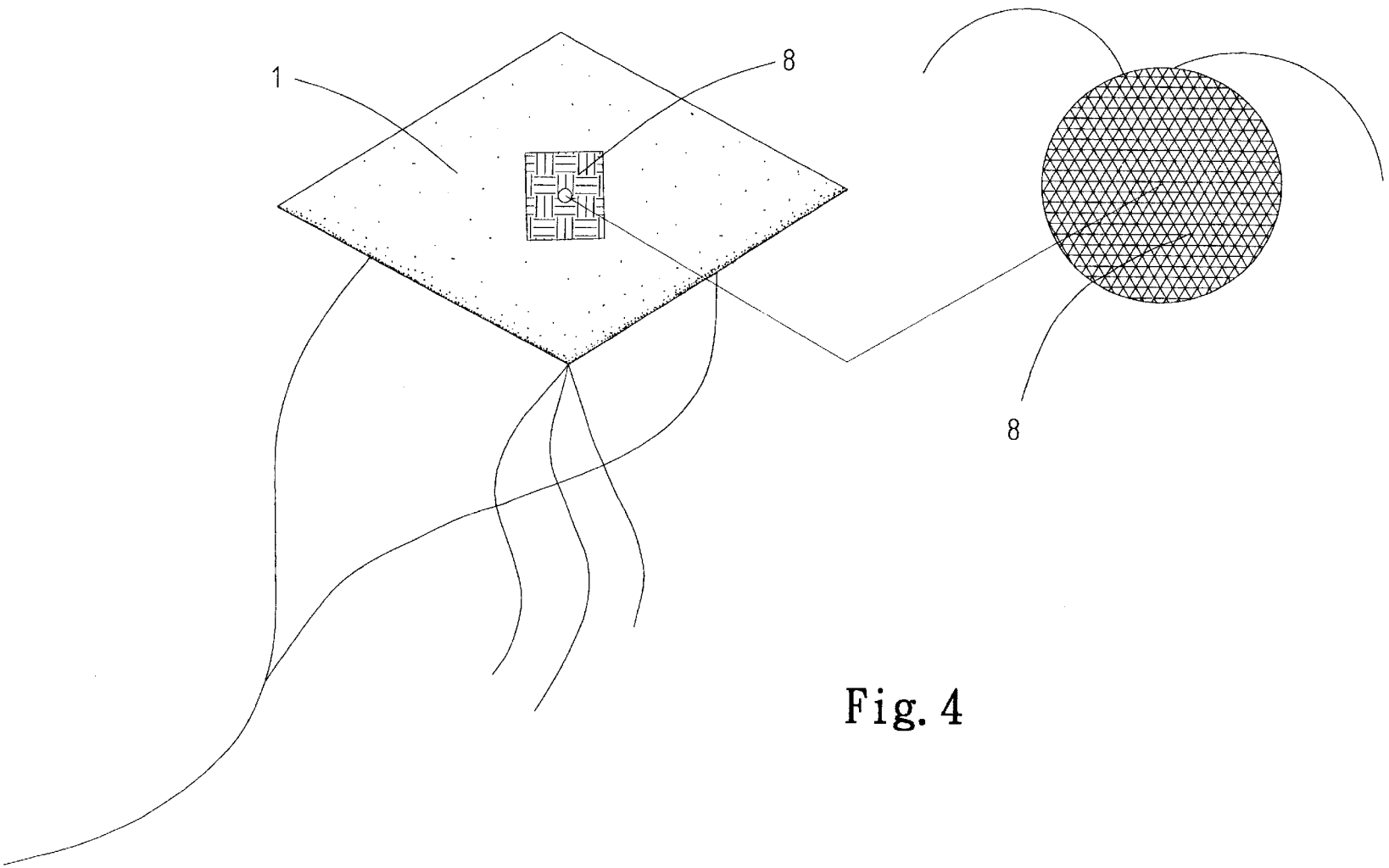
FIG. 4 is an exploded front view of the luminescent kite apparatus of FIG. 1.

Referring to FIG. 4, the luminescent panel 2 is mounted on the first side of the kite 1 via a hook-and-loop device 8. The hook-and-loop device 8 is conventional and therefore will not be described in detail. Due to the use of the hook-and-loop device 8, the luminescent panel 2 can be easily detached from the kite 1 for cleaning, repair or replacement.

Figure 5:
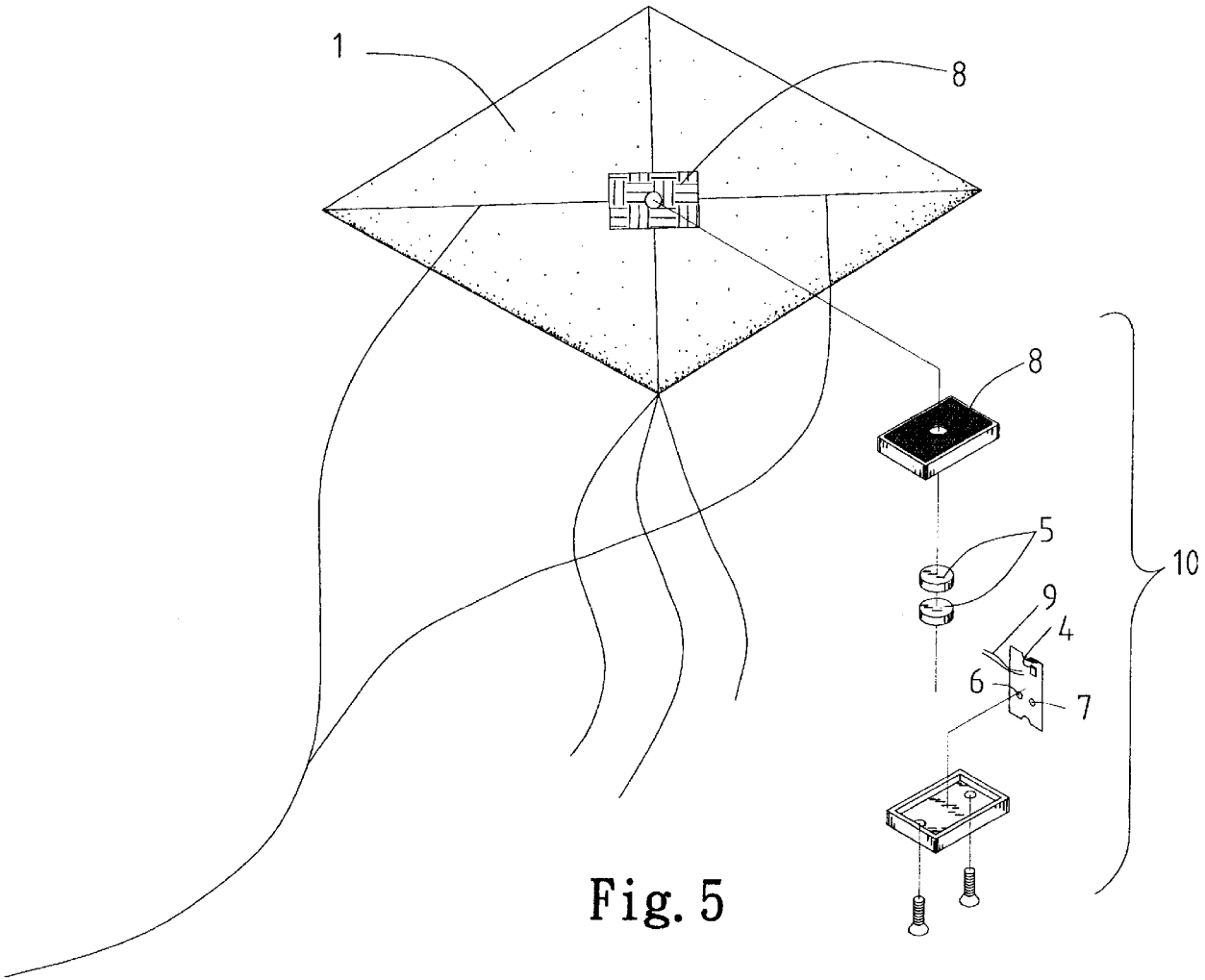
FIG. 5 is an exploded rear view of the luminescent kite apparatus of FIG. 1.
Figure 6:
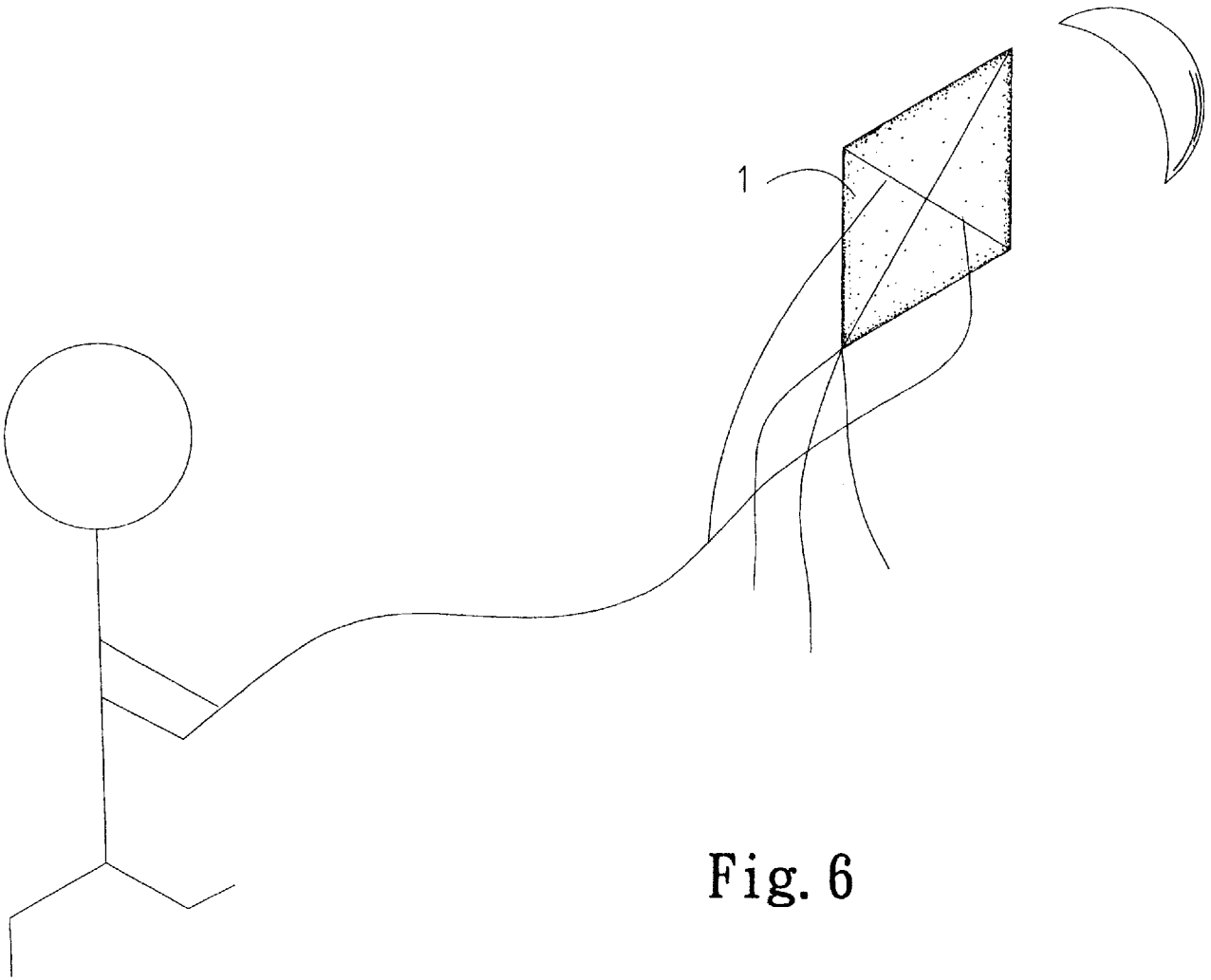
FIG. 6 is a view of a child playing with a conventional kite.

Referring to FIG. 5, the box 10 is opened. The box 10 includes a first portion mounted on the second side of the kite 1 by means of another hook-and-loop device 8 and a second portion that can be secured to the first portion by means of a number of screws (not numbered). Due to the hook-and-loop device 8, the box 10 can be easily detached from the kite 1 for cleaning, repair or replacement.

In the box 10, there is contained a circuit board 3 for driving the luminescent panel 2 to emit light in various ways. On the circuit board 3, there are installed a micro-controller 4, two batteries 5, a switch 6 and a vibration detector 7. The micro-controller 4 is used to control the operation of the entire circuit board 3. The batteries 5 are used to power the luminescent panel 2 and the entire circuit board 3. It is preferred that the batteries 5 can be recharged. By operating the switch 6, a person can select from the various ways for luminescence. If wind causes the kite 1 to vibrate in the sky, the vibration detector 7 detects the vibration and notifies the micro-controller 4 of such vibration. Accordingly, the micro-controller 4 causes the luminescent panel 2 to twinkle.

The luminescent panel 2 is connected with the circuit board 3 via two wires 9. Since the luminescent panel 2 and the box 10 are mounted on opposite sides of the kite 1, the wires 9 must be extended from one to the other side of the kite 1. To keep the wires 9 as short as possible, the wires 9 are extended through the kite 1. To this end, a hole is defined in the kite 1, each hook-and-loop device 8 and the first portion of the box 10, respectively. The wires 9 are inserted through the holes defined in the kite 1, the hook-and-loop devices 8 and the first portion of the box 10.

The present invention provides several advantageous features over prior art. Firstly, a user can play with the luminescent kite apparatus of the present invention in the dark. Secondly, the luminescent kite apparatus of the present invention provides various visual effects regarding different ways of luminescence, different colors of luminescence and different patterns.

The present invention has been described in detail for purposes of illustration. Those skilled in the art can derive a lot of variations from these embodiments after a study of this patent specification. Therefore, these embodiments shall by no means limit the scope of the present invention. The scope of the present invention can only be defined in the claims attached to and taken as a portion of this patent specification.

What is claimed is:

1. A light-emitting kite apparatus including a kite and a light-emitting device including:

a luminescent panel:

a hook-and-loop device for mounting the luminescent panel on a first side of the kite in a releasable manner; and a circuit board including a micro-controller installed thereon so as to drive the luminescent panel to emit light in various ways and a switch installed thereon for selection of one from the various ways in which the luminescent panel emits light.

2. The light-emitting kite apparatus according to claim 1 including two wires for connecting the light source with the circuit board.

3. The light-emitting kite apparatus according to claim 2 wherein the wires are extended through a hole defined in the kite.

4. The light-emitting kite apparatus according to claim 1 including a vibration detector installed on the circuit board under control of the micro-controller for detecting vibration of the kite and notifying the micro-controller of such vibration so that the micro-controller can cause the luminescent panel to twinkle.

5. The light-emitting kite apparatus according to claim 1 including a box for containing the circuit board.

6. The light-emitting kite apparatus according to claim 5 wherein the box is mounted on the second side of the kite in a detachable manner.

7. The light-emitting kite apparatus according to claim 6 wherein the box is mounted on the second side of the kite via a hook-and-loop device.

* * * * *